United States Patent [19]

Nill

[11] Patent Number: 4,806,819

[45] Date of Patent: Feb. 21, 1989

[54] SHADOW MASK MOUNTING APPARATUS IN A COLOR PICTURE TUBE

[75] Inventor: Eberhard Nill, Esslingen, Fed. Rep. of Germany

[73] Assignee: Nokia Graetz GmbH, Pforzheim, Fed. Rep. of Germany

[21] Appl. No.: 108,133

[22] Filed: Oct. 13, 1987

[30] Foreign Application Priority Data

Oct. 16, 1986 [DE] Fed. Rep. of Germany ..... 3635187

[51] Int. Cl.[4] ..... H01J 29/07

[52] U.S. Cl. ..... 313/404; 313/407

[58] Field of Search ..... 313/404, 405, 407, 402; 220/2.1 A

[56] References Cited

U.S. PATENT DOCUMENTS 3,873,874 3/1975 Shinal ..... 313/407 X

*Primary Examiner*—David K. Moore
*Assistant Examiner*—K. Wieder
*Attorney, Agent, or Firm*—Peter C. Van Der Sluys

[57] ABSTRACT

A shadow-mask color picture tube has a glass panel and glass funnel joined together via outwardly extending flange portions thereof. To mount a shadow mask in the picutre tube, holding plates are fastened between the flanges, preferably in internal recesses of the flanges, and each of the holding plates has a hole for a rivet which holds the mask and, in a preferred embodiment, an internal shield. The mask is preferably connected with the holding plates via bimetal elements.

20 Claims, 2 Drawing Sheets

SHADOW MASK MOUNTING APPARATUS IN A COLOR PICTURE TUBEBACKGROUND OF THE INVENTION

1. Field of the Invention

The present invention relates to a shadow-mask color picture tube comprising a quadrangular glass panel and a glass funnel which are joined together via outwardly extending flange portions.

2. Description of the Prior Art

A glass bulb for a picture tube is disclosed in U.S. Pat. No. 4,483,452, wherein both the panel and the funnel may be made of laminated sheet glass.

In the glass bulb of a shadow-mask color picture tube, the shadow mask must be mounted with very high accuracy, so that the holes in the mask are in register with the phosphor dots on the screen, and remain so during operation. Further complications result from the fact that in the process of fabricating a color picture tube, the mask must be removed from and reinserted into the panel assembly several times without adversely affecting the screen register. To support the mask, it is customary to provide the mask with a frame and to mount it by means of springs, spring holders, and pins.

SUMMARY OF THE INVENTION

An object of the present invention is to simplify and reduce the cost of a shadow-mask color picture tube and its fabrication.

The present invention contemplates a shadow-mask color picture tube having a quadrangular glass panel and a glass funnel which are joined together via outwardly extending flange portions. Internal recesses are formed at the corners of the flange portions and holding plates made of a material having a coefficient of thermal expansion matched to that of the glass material are fastened in the recesses between the flange portions.

By means of such holding plates, the shadow mask can be mounted in a simple but reliable and easily reproducible manner without the need for a mask frame, springs, and spring holders as are required in conventional tubes.

The holding plates may be fastened to the glass panel by means of adhesive bonding or glass fritting. Materials from which the holding plates may be made include ceramic material and an ironnickel alloy.

In another embodiment the mask is connected to the holding plates by means of bimetal elements joined to an edge of the mask to provde doming compensation. The holding plates may also be used to support an internal shield.

DESCRIPTION OF THE PREFERRED EMBODIMENT

A glass panel 1 and a glass funnel 2 are provided with outwardly extending flanges 3 and 4 for joining the two parts together.

Figure 1:
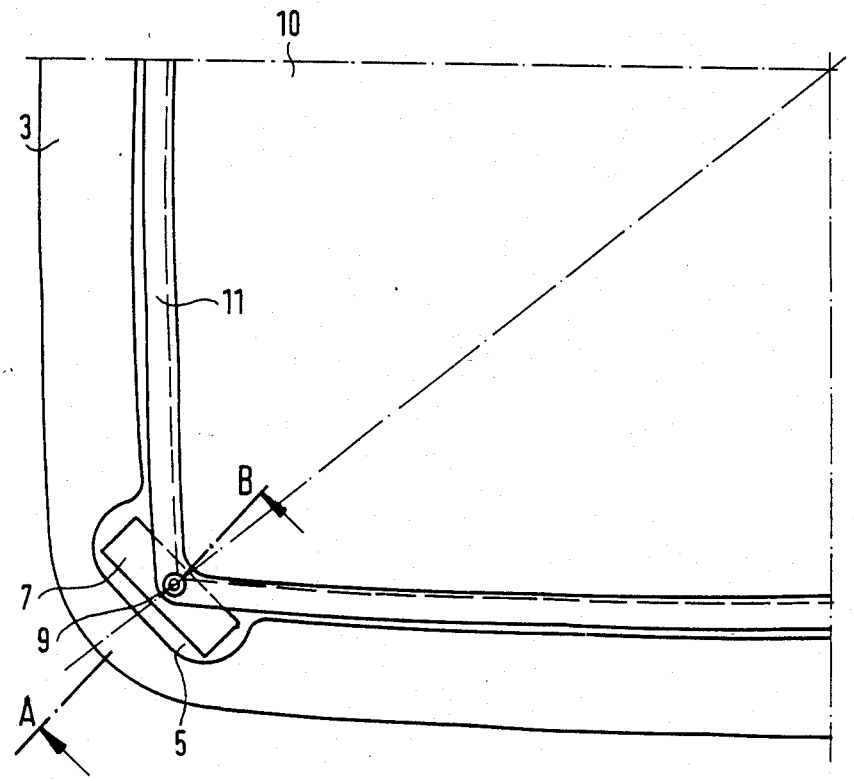
FIG. 1 is a top view of the inside of a portion of a panel.

FIG. 1 shows a portion of the panel in a top view. The panel flange 3 has a recess 5 formed in a corner in which a holding plate 7 is fastened. The holding plate 7 is made of a material which has a coefficient of thermal expansion matched to that of the glass material of the panel. The holding plate material is preferably a ceramic material or an iron-nickel alloy. The holding plate 7 is fastened in the recess 5 of the panel flange 3 with a suitable thermally stable adhesive or with glass frit.

Plate 7 has a hole 8 to be used for mounting mask 10 which includes an edge 11 having holes corresponding to the holes formed in the holding plates. A pin 9 passes through the aligned holes in the holding plate 7 and edge 11 for mounting the mask 10.

It should be pointed out that during the picture tube fabrication process, in which the mask 10 must be removed from and reinserted into the panel 1 several times, use can only be made of fastening means which permit replacement of the mask 10. To finally mount the mask 10, other fasteners 9, such as rivets, can be used.

Figure 2:
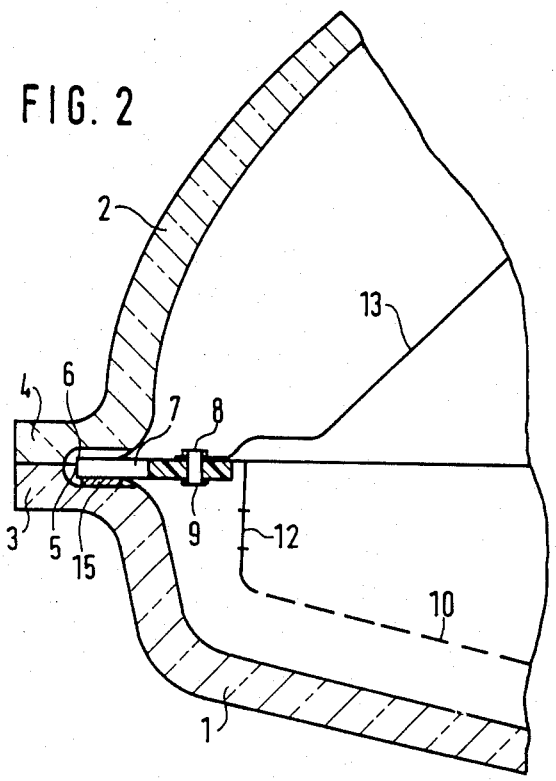
FIG. 2 is a section taken along line A-B of FIG. 1, with the funnel joined to the panel.

FIG. 2 is a longitudinal section taken along line A-B of FIG. 1 showing the funnel 2 joined to the panel 1. The panel flange 3, formed on the panel 1, and the funnel flange 4, formed on the funnel 2, serve to join the panel and the funnel together. The holding plate 7 is fastened in the recess 5 of the panel flange 3 by means of a suitable material 15, such as glass frit. It may be advantageous to also provide the funnel flange 4 with a corresponding recess 6, as shown in FIG. 2. The mask 10, which has a window at 12, is fastened to the holding plate 7 be means of the pin 9 inserted in hole 8. This pin 9 may be a tubular rivet or a dummy rivet. The holding plate 7 can also be used to mount a shield 13.

The mounting shown in FIGS. 1 and 2 is provided at all four corners of the picture tube.

Figure 3:
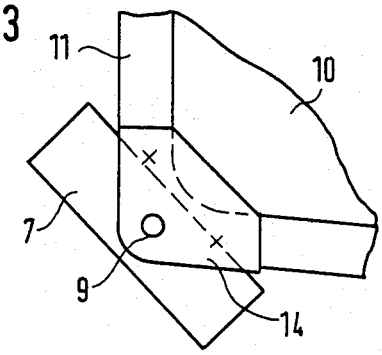
FIG. 3 is a top view showing a portion of another embodiment of the invention.

With this mounting, doming compensation can be achieved in a simple manner by connecting the mask with the holding plate via bimetal elements. Such an arrangement is shown in FIG. 3. Suitable bimetal elements 14 are joined to the edge 11 of the mask 10 by welding, for example. They are in turn connected with the holding plate 7 by means of the pin 9.

The invention simplifies and reduces the cost of the fabrication of the shadow-mask color picture tube considerably. Since it also provides a weight saving, it can be used to advantage with picture tubes whose panel and funnel are made of laminated sheet glass, because the weight of such a tube is reduced by about 40%.

What is claimed is:

1. A shadow-mask color picture tube, comprising:

a quadrangular glass panel having an outwardly extending peripheral flange;

a glass funnel having an outwardly extending peripheral flange, said panel and funnel being joined together via said flange portions to form said picture tube;

holding plates fastened between said flanges and extending inwardly inside the picture tube; and a shadow mask mounted to said holding plates.

2. A shadow-mask color picture tube as claimed in claim 1, wherein the holding plates are fastened by adhesive bonding.

3. A shadow-mask color picture tube as claimed in claim 1, wherein the holding plates are fastened by fritting.

4. A shadow-mask color picture tube as claimed in claim 1, wherein the flange of the panel has internal recesses and said plates are fastened in said internal recesses.

5. A shadow-mask color picture tube as claimed in claim 4, wherein the internal recesses are formed at corners of the panel.

6. A shadow-mask color picture tube as claimed in claim 4, wherein the mask is mounted to the holding plates by means of bimetal elements joined to the mask.

7. A shadow-mask color picture tube as claimed in claim 4, wherein the flange of the funnel has internal recesses corresponding to the internal recesses of the flange portion of the panel.

8. A shadow-mask color picture tube as claimed in claim 7, wherein the internal recesses are formed at corners of the panel.

9. A shadow-mask color picture tube as claimed in claim 7, wherein the mask is mounted to the holding plates by means of bimetal elements joined to the mask.

10. A shadow-mask color picture tube as claimed in claim 1, wherein the holding plates are made of ceramic material.

11. A shadow-mask color picture tube as claimed in claim 1, wherein the holding plates are made of an iron-nickel alloy.

12. A shadow-mask color picture tube as claimed in claim 1, wherein the holding plates have holes, the mask has corresponding holes and mounted to the holding plates by means of pins entering said holes.

13. A shadow-mask color picture tube as claimed in claim 12, wherein the pins are tubular rivets.

14. A shadow-mask color picture tube as claimed in claim 12, wherein the pins are dummy rivets.

15. A shadow-mask color picture tube as claimed in claim 1, wherein the mask is mounted to the holding plates by means of bimetal elements joined to the mask.

16. A shadow-mask color picture tube as claimed in claim 15, additionally comprising an internal shield fastened to the holding plates.

17. A shadow-mask color picture tube as claimed in claim 1, additionally comprising an internal shield fastened to the holding plates.

18. A shadow-mask color picture tube as claimed in claim 1, wherein the panel and the funnel are made of laminated sheet glass.

19. A shadow-mask color picture tube, as claimed in claim 1, wherein the shadow mask includes an outwardly extending edge, said edge being mounted directly to said holding plates.

20. A shadow-mask color picture tube comprising:

a quadrangular glass panel having an outwardly extending peripheral flange;

a glass funnel having an outwardly extending peripheral flange, said panel and funnel being joined together via said flanges to form said picture tube;

holding plates fastened between said flanges only at the corners of said quadrangular glass panel and extending inwardly inside the picture tube; and a shadow mask mounted to said holding plates.

* * * * *